US006945138B1

(12) United States Patent
Kreitzer

(10) Patent No.: US 6,945,138 B1
(45) Date of Patent: Sep. 20, 2005

(54) RECOILING STRIKING DEVICE

(76) Inventor: David F. Kreitzer, 5101 N. 69th Pl., Paradise Valley, AZ (US) 85253

( * ) Notice: Subject to any disclaimer, the term of this patent is extended or adjusted under 35 U.S.C. 154(b) by 0 days.

(21) Appl. No.: 10/626,107

(22) Filed: Jul. 24, 2003

Related U.S. Application Data

(60) Provisional application No. 60/398,251, filed on Jul. 24, 2002.

(51) Int. Cl.[7] ..... B25D 1/12
(52) U.S. Cl. ..... 81/22; 30/308.1
(58) Field of Search ..... 81/20, 22; 30/308.1

(56) References Cited

U.S. PATENT DOCUMENTS 1,794,008 A 2/1931 Forbes
3,961,519 A 6/1976 Kurata
5,029,496 A 7/1991 Catania
5,282,805 A 2/1994 Richelsoph et al.
5,916,338 A 6/1999 Bergkvist et al.
5,992,270 A 11/1999 Hedelin et al.
6,016,722 A 1/2000 Gierer et al.
6,128,977 A * 10/2000 Gierer et al. ..... 81/22
6,158,307 A 12/2000 Lamond et al.
6,202,511 B1 3/2001 Murray et al.
6,234,048 B1 5/2001 Carmien
6,363,817 B1 4/2002 Lamond et al.

* cited by examiner

*Primary Examiner*—James G. Smith
(74) *Attorney, Agent, or Firm*—Parsons & Goltry; Robert A. Parsons; Michael W. Goltry

(57) ABSTRACT

A striking device including a head having a striking surface and a base mounted on an end of a handle for reciprocation in a linear motion. A rail structure is carried by the end of the handle. A rail receiving structure is carried by the base and receives the rail structure for reciprocating linear motion of the head between a forward position and a rearward position. A biasing structure biases the head into the forward position.

17 Claims, 4 Drawing Sheets

FIGURE 3
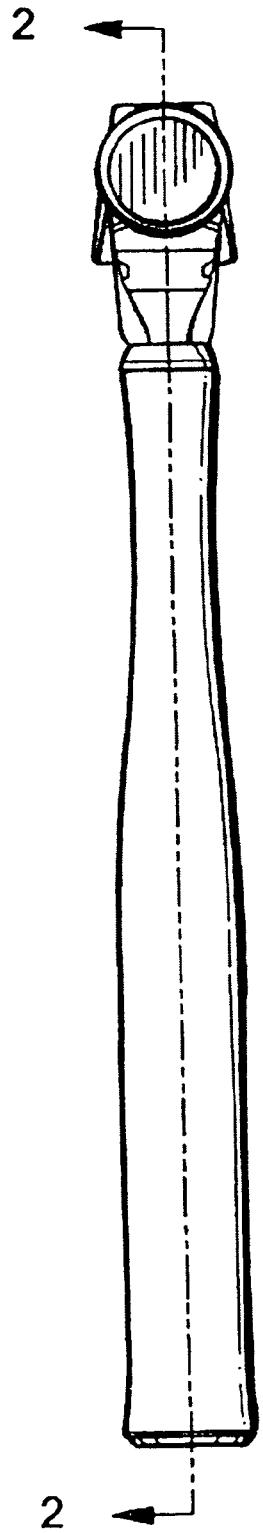
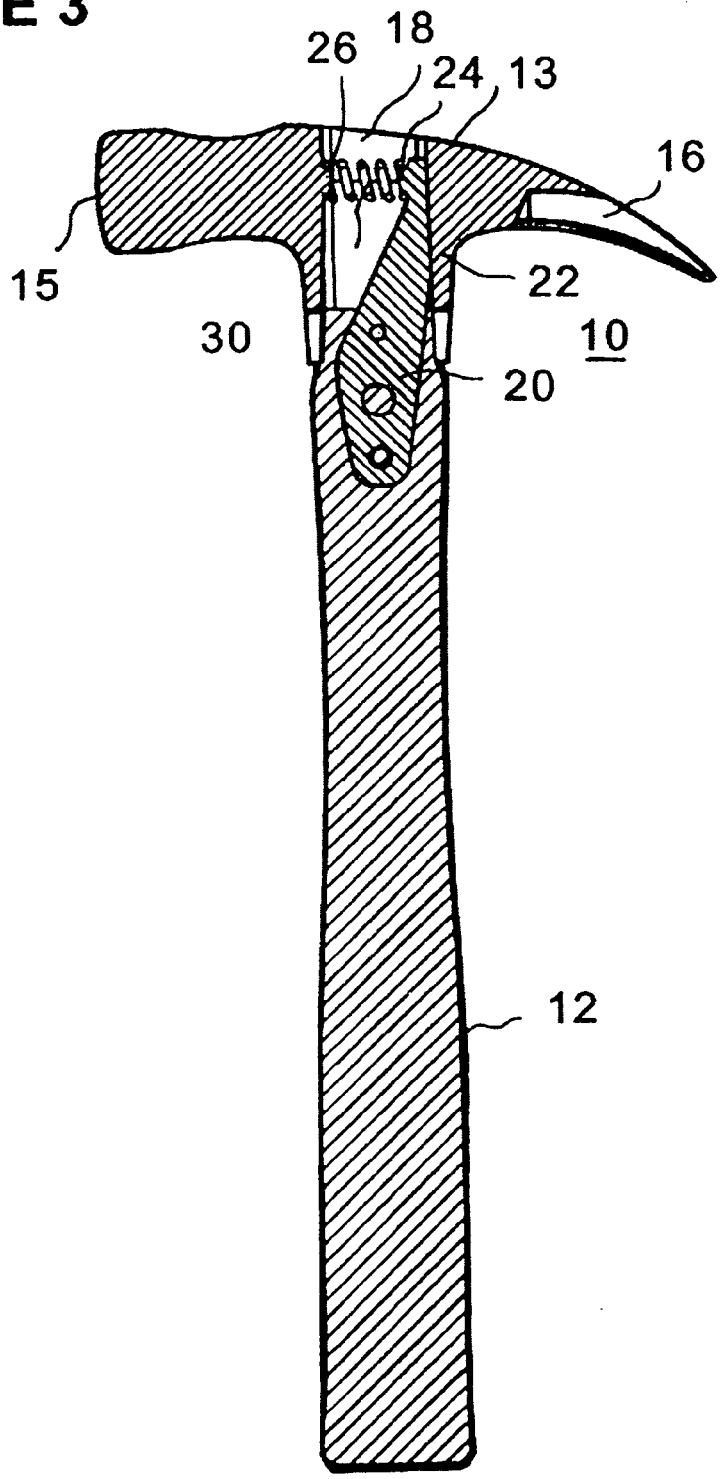
FIGURE 2

FIGURE 7
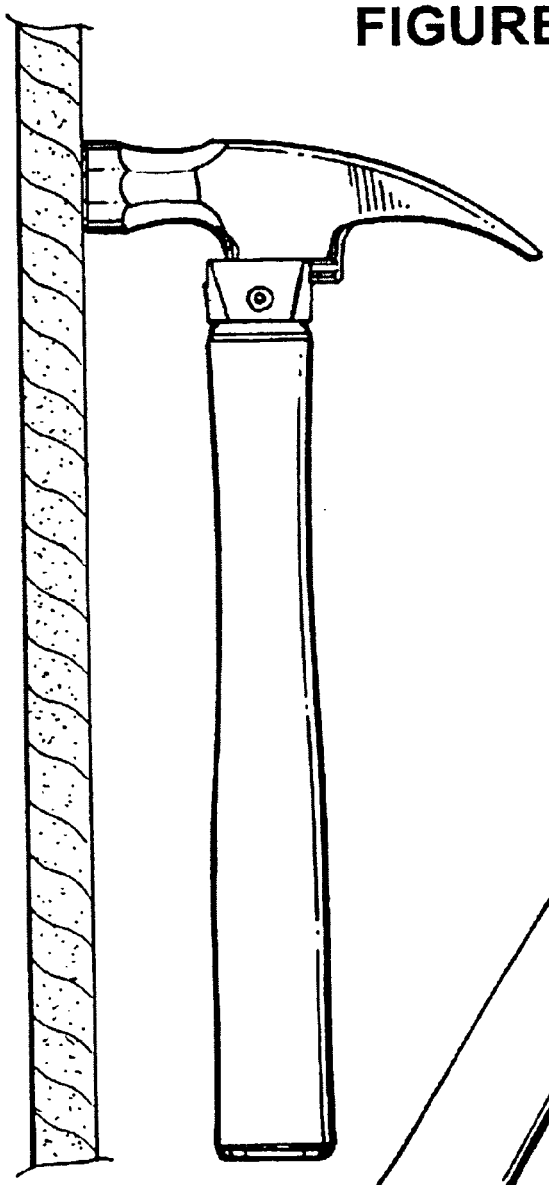
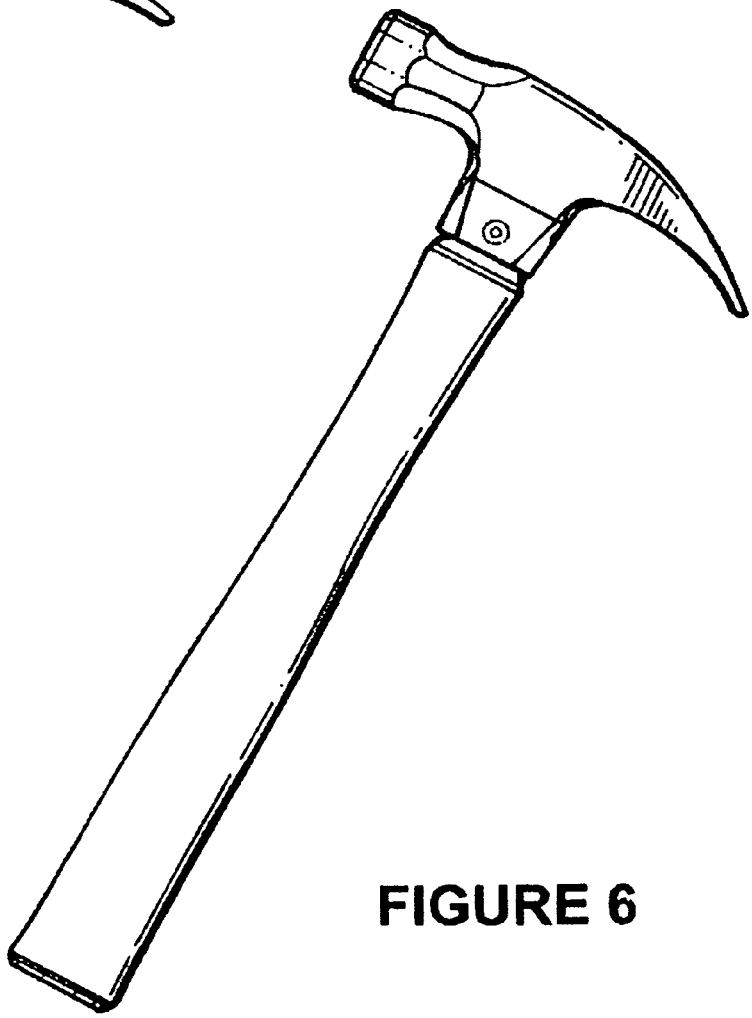
FIGURE 6

RECOILING STRIKING DEVICE

CROSS-REFERENCE TO RELATED APPLICATION

This application claims the benefit of U.S. Provisional Patent Application No. 60/398,251, filed 24 Jul. 2002.

FIELD OF THE INVENTION

This invention relates to striking devices, such as hammers and the like.

More particularly, the present invention relates to striking devices incorporating recoil apparatus.

BACKGROUND OF THE INVENTION

In the building industry, striking devices, such as hammers and the like (hereinafter "hammer") are used for a multitude of purposes including driving nails, straightening and/or adjusting items, and various other actions requiring a striking motion from a heavy solid tool. In a days work, for example, a carpenter can perform thousands of strikes with a hammer. Each time the hammer is used to strike an object the force of the strike rebounds or reacts through the handle and against the user's hand and arm. Thus, the carpenter who performs thousands of strikes with a hammer receives thousands of substantially equal and opposite rebound forces on his hand, and arm. These rebound forces can eventually cause serious health problems and even prevent further work by the carpenter.

It would be highly advantageous, therefore, to remedy the foregoing and other deficiencies inherent in the prior art.

Accordingly, it is an object the present invention to provide a new and improved hammer incorporating recoil apparatus that reduces or eliminates the rebound or shock forces on the user's hand and arm.

Another object of the present invention is to provide a new and improved hammer incorporating recoil apparatus that is simple and inexpensive to manufacture.

And another object of the present invention is to provide a new and improved hammer incorporating recoil apparatus that does not reduce the efficiency of the hammer.

SUMMARY OF THE INVENTION

Briefly, to achieve the desired objects of the instant invention in accordance with a preferred embodiment thereof, provided is a striking device including a head having a striking surface and a base mounted on an end of a handle for reciprocation in a linear motion. A rail structure is carried by the end of the handle. A rail receiving structure is carried by the base and receives the rail structure for reciprocating linear motion of the head between a forward position and a rearward position. A biasing structure biases the head into the forward position.

In a specific aspect, the rail structure includes a pair of rail tabs fixedly attached to the end of the handle at opposite sides thereof. The rail structure includes a pair of rail clamps each including a generally U-shaped vertical slot which encompasses approximately one-half of the end of the handle and which are fixedly attached to opposite sides thereof. The rail receiving structure includes opposed elongated slide slots formed on opposite sides of the base receiving the rails tabs.

In another aspect of the invention, the biasing structure includes an opening formed in the head, defined by a forward surface and a rearward surface. A tang extends longitudinally from the end of the handle and into the opening A compression spring is carried between the tang and the forward surface of the head. The spring biases the forward surface of the head away from the tang and positions the tang proximate the rearward surface of the head.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which:

FIG. 2 is a sectional view of the hammer of FIG. 1, illustrating the inner assembly;

FIG. 3 is a front view of the hammer of FIG. 1;

FIG. 6 is a side view of the hammer of FIG. 1 in a striking position; and FIG. 7 is a side view of the hammer of FIG. 1 in the process of striking an object, illustrating the recoil orientation.

DETAILED DESCRIPTION OF A PREFERRED EMBODIMENT

Figure 1:
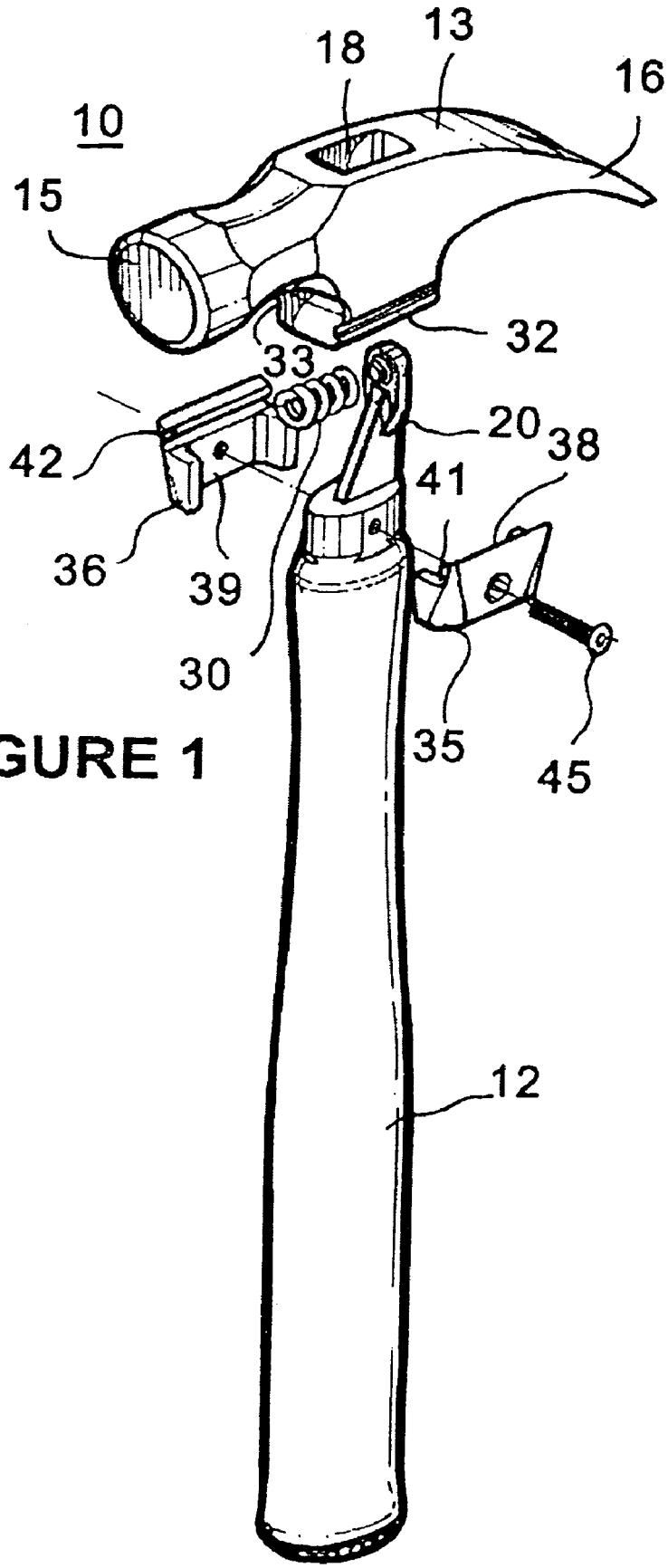
FIG. 1 is an exploded view in perspective of a hammer incorporating recoil apparatus in accordance with the present invention.

Turning now to the drawings in which like reference characters indicate corresponding elements throughout the several views, attention is directed to FIGS. 1–3, which illustrate a striking device, hereinafter hammer 10. Hammer 10 includes a handle 12 and a head 13 with a striking surface 15 and claws 16. An opening 18 is formed in head 13 for mounting head 13 on handle 12. Generally, opening 18 is similar to mounting openings formed in the heads of prior art hammers for receiving the head end of an associated handle and is defined by an inner surface having a forward surface, toward the striking surface, and a rearward surface. As in any standard hammer, head 13 is used for driving nails or striking objects and claws 16 are used for pulling nails or otherwise applying a lever action to objects. It will be understood that while claws 16 are shown in this embodiment, they may be omitted as desired.

In hammer 10, a tang 20 is imbedded in the head-end of handle 12 so as to extend outwardly therefrom in a longitudinal direction. Further, tang 20 is formed and positioned so that a rear edge 22 buts against the rearward surface of opening 18 adjacent claws 16 when handle 12 is properly engaged with head 13. The front edge of tang 20 is sloped or angled downward toward the front of hammer 10 increasing the width of tang 20 toward the head-end of handle 12 so as to provide a maximum amount of rigidity. In this preferred embodiment tang 20 is formed of a very rigid metal, such as steel or the like. Also, it should be understood that while tang 20 is imbedded in handle 12, which is constructed of wood or the like in this example, in hammers that include a metal handle tang 20 could be formed as an integral part of the handle.

The upper end of tang 20 is constructed with a forward-facing flat surface on the forward edge and a small nipple 24 is formed on the flat surface for engaging one end of a compression spring 30. A second nipple 26 is formed on the forward surface of opening 18 facing tang 20 and aligned with nipple 24 so as to receive and engage the opposite end of compression spring 30. Compression spring 30 biases the forward surface of opening 18 of head 13 away from tang 20 with the rearward surface of opening 18 positioned tightly against the rear edge of tang 20, as illustrated best in FIG. 2.

The lower portion or base of head 13 carries a rail receiving structure. In this preferred embodiment, the rail receiving structure includes opposed elongated slide slots 32 and 33 formed on opposite sides of the base. Slide slots 32 and 33 extend from back to front of head 13 (i.e., from adjacent claws 16 to adjacent surface 15). In this preferred embodiment, slide slots 32 and 33 are formed as an integral part of head 13. However, in specific applications or in renovations (i.e., after market renovations) the slide slots can be formed as a separate component that can be attached to the lower surface of a hammerhead already in existence.

A rail structure is carried by the head-end of handle 12. In this embodiment, the rail structure includes a pair of rail clamps or grips 35 and 36 fixedly attached to the head-end of handle 12 at opposite sides thereof. Rail grips 35 and 36 are each formed with a generally U-shaped vertical slot 38 and 39, respectively that is designed to encompass approximately one-half of the head-end of handle 12. Each rail grip 35 and 36 includes an inwardly directed rail or rail tab 41 and 42, respectively. Rail grips 35 and 36 are positioned so rail tabs 41 and 42 slideably engage in slide slots 32 and 33, respectively, for relative backward and forward movement between head 13 and handle 12. In other words, rail tabs 41 and 42, and slide slots 32 and 33 facilitate reciprocating linear movement of head 13 between a forward position and a rearward position. A linear motion maintains the orientation of the striking surface of head 13. In this preferred embodiment, rail grips 35 and 36 are positioned on opposite sides of the head end of handle 12 and affixed to handle 12 by means of a clamping screw 45 that extends through rail grip 35 and handle 12 and is threadedly engaged in rail grip 36. It should be understood that single rails and grips or multiple combinations thereof can be employed.

Figure 4:
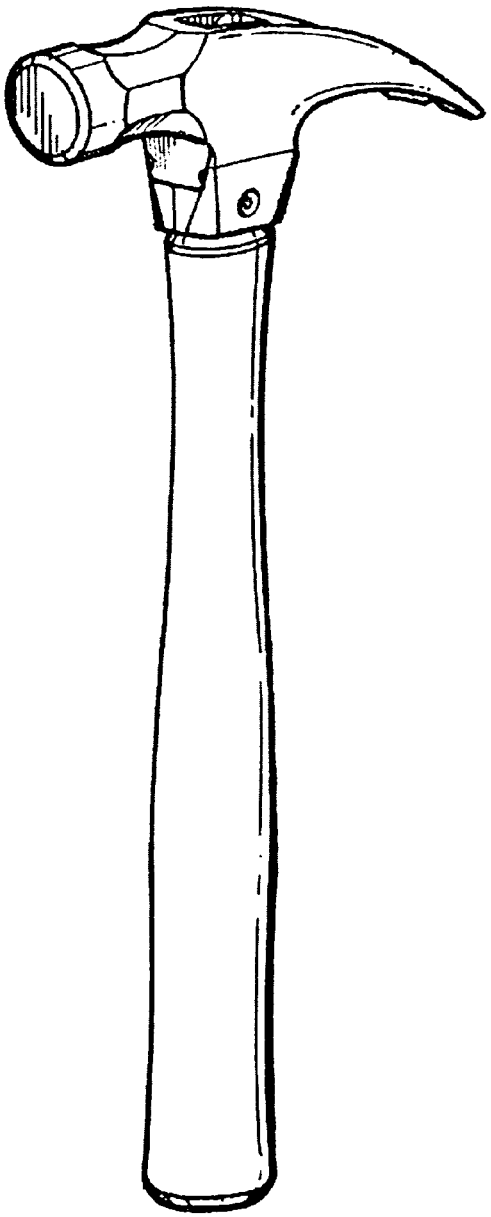
FIG. 4 is a view in perspective of the hammer of FIG. 1 assembled and in the normal or at-rest orientation.
Figure 5:
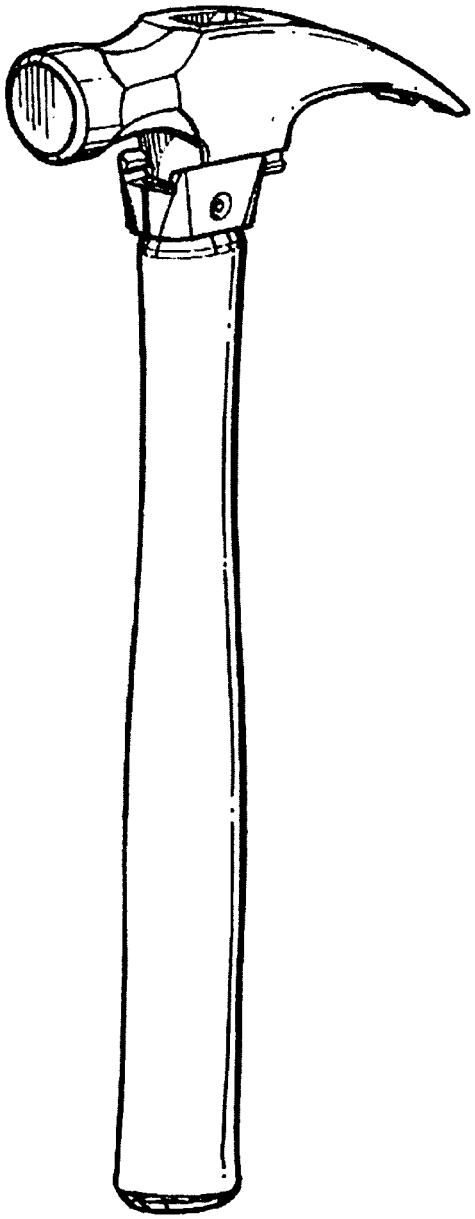
FIG. 5 is a view in perspective of the hammer of FIG. 1 assembled and in a recoil orientation immediately subsequent to the act of striking an object.

In the assembly process, tang 20 on handle 12 is inserted into opening 18 of head 13. Compression spring 30 is positioned between the front surface of tang 20 and the rearwardly facing inner surface of opening 18 with one end engaged over nipple 24 and the other end engaged over nipple 26. In this orientation the rear edge of tang 20 is biased tightly against the forwardly facing inner surface of opening 18. Rail grips 35 and 36 are then assembled on the head-end of handle 12 so that rail tabs 41 and 42 are slideably engaged in slide slots 32 and 33, respectively. Clamping screw 45 is then inserted through the holes in rail grip 35 and handle 12 and screwed into the threaded hole in rail grip 36 to-tightly clamp rail grips 35 and 36 onto the head-end of handle 12. Assembled hammer 10 now appears, as illustrated in FIGS. 3, 4, and 6, generally similar in appearance to prior art hammers. However, the recoil apparatus provides for limited transverse movement of head 13 relative to handle 12 during striking operations.

In operation, as hammer 10 is brought into contact with an object it is desired to strike, such as a nail or surface 50 illustrated in FIG. 7, the full impact of hammer 10 strikes surface 50. However, handle 12 continues to move as spring 30 is compressed and the shock of the strike is absorbed. In this recoil orientation, rail tabs 41 and 42 on rail grips 35 and 36, respectively, slide forward in slide slots 32 and 33, allowing tang 20 to move forward in opening 18 and compress spring 30. The compression of spring 30 absorbs all or a substantial amount of the shock force that would normally be transmitted to handle 12 when head 13 strikes object 50. Subsequent to the strike, compression spring 30 immediately expands to move head 13 back into the normal or pre-strike orientation in readiness for the next strike. Furthermore, the lateral translation of bead 13 allows claws 16 to be used in a generally conventional manner.

Here it should be noted that the recoil apparatus, including spring 30, can be constructed to accommodate different size and weight hammers. Also, different size compression springs (e.g., different amounts of compression) can be incorporated to accommodate users with more or less powerful striking capabilities. Further, many hammers or other striking devices already on the market or in use can be modified to incorporate the novel recoil apparatus. Once the recoil apparatus is incorporated spring 30 can be easily changed to accommodate different users.

Thus, a new and improved hammer incorporating novel recoil apparatus has been disclosed, which is highly adaptable and easy to operate. Specifically, the new and improved hammer and recoil apparatus reduces or eliminates the rebound or shock forces on the user's hand and arm. Further, the new and improved hammer and recoil apparatus is simple and inexpensive to manufacture and does not reduce the efficiency of the hammer.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A striking device comprising:

a handle having an end;

a rail structure carried by the end of the handle;

a head having a striking surface and a base;

a rail receiving structure carried by the base and receiving the rail structure for reciprocating linear motion of the head between a forward position and a rearward position; and a biasing structure biasing the head into the forward position.

2. A striking device as claimed in claim 1 wherein the rail structure includes a pair of rail tabs fixedly attached to the end of the handle at opposite sides thereof.

3. A striking device as claimed in claim 2 wherein the rail structure includes a pair of rail clamps each including a generally U-shaped vertical slot which encompasses approximately one-half of the end of the handle and which are fixedly attached to opposite sides thereof.

4. A striking device as claimed in claim 2 wherein the rail receiving structure includes opposed elongated slide slots formed on opposite sides of the base receiving the rails tabs.

5. A striking device as claimed in claim 1 wherein the biasing structure includes:

the head having an opening formed therein, defined by a forward surface and a rearward surface;

a tang extending longitudinally from the end of the handle into the opening; and a compression spring carried between the tang and the forward surface of the head, the spring biasing the forward surface of the head away from the tang and positioning the tang proximate the rearward surface of the head.

6. A striking device as claimed in claim 5 wherein the tang thickens from a flattened end to the end of the handle.

7. A striking device as claimed in claim 6 wherein the flattened end of the tang includes a forwardly directed projection and the forward surface of the opening having a rearwardly directed projection, the compression spring receiving the forwardly directed projection and the rearwardly directed projection in opposing ends thereof.

8. A striking device as claimed in claim 5 wherein the tang is integrally formed with the handle.

9. A striking device comprising:

a handle having an end;

a rail structure carried by the end of the handle;

a head having a striking surface and a base perpendicular to the striking surface;

an opening formed in the head defined by an inner surface having a forward surface and a rearward surface;

a rail receiving structure carried by the base and receiving the rail structure for reciprocating linear motion of the head between a forward position and a rearward position;

a tang extending longitudinally from the end of the handle into the opening of the head; and a compression spring carried between the tang and the forward surface of the head, the spring biasing the forward surface of the head away from the tang and positioning the tang proximate the rearward surface of the head.

10. A striking device as claimed in claim 9 wherein the rail structure includes a pair of rail tabs fixedly attached to the end of the handle at opposite sides thereof.

11. A striking device as claimed in claim 10 wherein the rail structure includes a pair of rail clamps each including a generally U-shaped vertical slot which encompasses approximately one-half of the end of the handle and which are fixedly attached to opposite sides thereof.

12. A striking device as claimed in claim 10 wherein the rail receiving structure includes opposed elongated slide slots formed on opposite sides of the base receiving the rails tabs.

13. A striking device as claimed in claim 12 wherein the tang thickens from a flattened end to the end of the handle.

14. A striking device as claimed in claim 13 wherein the flattened end of the tang includes a forwardly directed projection and the forward surface of the opening having a rearwardly directed projection, the compression spring receiving the forwardly directed projection and the rearwardly directed projection in opposing ends thereof.

15. A striking device comprising:

a handle having an end;

a pair of rail tabs fixedly attached to the end of the handle at opposite sides thereof;

a head having a striking surface and a base;

opposed elongated slide slots formed on opposite sides of the base, the rail tabs received therein to facilitate a reciprocating linear motion of the head between a forward position and a rearward position; and a biasing structure biasing the head into the forward position including the head having an opening formed therein, defined by a forward surface and a rearward surface, a tang extending longitudinally from the end of the handle into the opening, and a compression spring carried between the tang and the forward surface of the head, the spring biasing the forward surface of the head away from the tang and positioning the tang proximate the rearward surface of the head.

16. A striking device as claimed in claim 15 wherein the tang thickens from a flattened end to the end of the handle.

17. A striking device as claimed in claim 16 wherein the flattened end of the tang includes a forwardly directed projection and the forward surface of the opening having a rearwardly directed projection, the compression spring receiving the forwardly directed projection and the rearwardly directed projection in opposing ends thereof.

* * * * *